US006654679B2

(12) United States Patent
Baeuerle et al.

(10) Patent No.: US 6,654,679 B2
(45) Date of Patent: Nov. 25, 2003

(54) METHOD, COMPUTER PROGRAM AND CONTROL SYSTEM FOR DETERMINING THE AIR MASS WHICH IS SUPPLIED TO AN INTERNAL COMBUSTION ENGINE VIA AN INTAKE MANIFOLD

(75) Inventors: Michael Baeuerle, Markgroeningen (DE); Klaus Ries-Mueller, Bad Rappenau (DE)

(73) Assignee: Robert Bosch GmbH, Stuttgart (DE)

( * ) Notice: Subject to any disclaimer, the term of this patent is extended or adjusted under 35 U.S.C. 154(b) by 272 days.

(21) Appl. No.: 09/918,467

(22) Filed: Aug. 1, 2001

(65) Prior Publication Data

US 2002/0016664 A1 Feb. 7, 2002

(30) Foreign Application Priority Data

Aug. 2, 2000 (DE) ..... 100 37 569

(51) Int. Cl.[7] ..... F02D 41/18

(52) U.S. Cl. ..... 701/109; 701/114; 701/115; 701/29; 73/118.2

(58) Field of Search ..... 701/109, 102, 701/110, 114, 115, 29, 34; 123/399, 396, 436; 73/117.3, 118.2

(56) References Cited

U.S. PATENT DOCUMENTS

| | | | | | |
|---|---|---|---|---|---|
| 5,095,874 | A | * | 3/1992 | Schnaibel et al. | 123/399 |
| 5,205,260 | A | * | 4/1993 | Takahashi et al. | 73/118.2 |
| 5,282,449 | A | * | 2/1994 | Takahashi et al. | 123/350 |
| 5,429,091 | A | * | 7/1995 | Huber et al. | 123/399 |
| 6,058,708 | A | * | 5/2000 | Heinitz et al. | 60/602 |
| 6,116,210 | A | * | 9/2000 | Oder et al. | 123/435 |
| 6,393,345 | B1 | * | 5/2002 | Kerns et al. | 701/34 |
| 6,513,495 | B1 | * | 2/2003 | Franke et al. | 123/436 |
| 2002/0166322 | A1 | * | 11/2002 | Weinreuter | 60/602 |

* cited by examiner

*Primary Examiner*—Hieu T. Vo
(74) *Attorney, Agent, or Firm*—Walter Ottesen

(57) ABSTRACT

An air mass is supplied to the combustion chambers by an intake manifold (12) in an internal combustion engine (10). An underpressure store (18) of a servo system (20) can be subjected to an underpressure via this intake manifold (12). The air mass flow in the inlet region (30) of the intake manifold (12) is determined by a sensor (32) and is supplied to an electronic control unit (26) for the fill computation. The actuation of the servo system (20) is detected and the determined air mass flow is corrected with or directly after a detected actuation of the servo system (20).

15 Claims, 5 Drawing Sheets

METHOD, COMPUTER PROGRAM AND CONTROL SYSTEM FOR DETERMINING THE AIR MASS WHICH IS SUPPLIED TO AN INTERNAL COMBUSTION ENGINE VIA AN INTAKE MANIFOLD

FIELD OF THE INVENTION

The invention relates to a method for determining the air mass which is supplied to an internal combustion engine via an intake manifold. An underpressure is applied to an underpressure store of a servo system via the intake manifold. The air mass flow is determined in the inlet region of the intake manifold.

BACKGROUND OF THE INVENTION

A method of the kind referred to initially herein is conventional in motor vehicles in the marketplace. A sensor is mounted in the region of the intake manifold of the engine and is usually a hot-film sensor which measures the air mass flow arriving in the intake manifold from the inlet thereof. This sensor signal is transmitted to a central electronic control unit which uses the signal to adjust the injection quantity of the fuel (if required, the injection time point of the fuel as well as the ignition time point) in dependence upon the desired torque and in view of the lowest possible fuel consumption and the lowest possible toxic substance emission.

However, in motor vehicles, evermore servo systems are used which assist the user. These systems include, for example, the following: brake booster, power steering as well as the control of air flaps of a climate control system.

However, it has been shown that there are deviations of the toxic substance emissions from the optimal values when actuating specific servo systems.

SUMMARY OF THE INVENTION

It is an object of the invention to provide a method which will avoid the above-mentioned deviations.

In a combination of an internal combustion engine and a servo system having an underpressure store, the method of the invention is for determining the air mass supplied to the engine via an intake manifold thereof. The method includes the steps of: applying an underpressure to the underpressure store via the intake manifold; determining the air mass flow in the inlet region of the intake manifold; detecting an actuation of the servo system; and, correcting the determined air mass flow at or directly after the detected actuation of the servo system.

The measures according to the invention are based on the following considerations. The energy for operating pneumatic servo systems is made available by an underpressure store which is fluidly connected to the intake manifold. The underpressure, which is necessary in the store for operating the servo systems, compared to the ambient pressure is effected by evacuating the underpressure store based on the underpressure present in the intake manifold.

The detection of the air mass flow must take place in the inlet region of the intake manifold because of flow and geometric reasons. However, the maximum underpressure in the intake manifold is achieved only downstream of this location. For these reasons, and when evacuating the underpressure store, air from the underpressure store flows into the intake manifold and is not detected by the sensor measuring the air mass flow. This, in turn, has the consequence that more air reaches the combustion chamber of the engine than was detected by the sensor. This finally leads to the situation that the mixture is leaner than assumed by the electronic control unit and this negatively influences the emission of toxic substances.

According to the invention, it was recognized that air masses from the underpressure store only flow into the intake manifold when a servo system, which is connected to the underpressure store, is actuated. Accordingly, and in accordance with the invention, a corrective term is added to the determined air mass flow when a servo system is actuated and the conditions, which form the basis of the computation in the electronic control unit, approximate the real conditions so that the toxic substance emissions are affected only to a slight extent or not at all by the actuation of the servo system.

Basically, it would be possible to add a constant corrective term to the measured air mass flow when a servo system is actuated. Actually, the air mass flow, which flows from the underpressure store into the intake manifold, is, however, dependent upon the pressure difference between the pressure present in the underpressure store and the pressure present in the inlet region of the intake manifold. According to another embodiment of the method of the invention, this is accounted for with the following steps:

(a) determining the pressure present in the intake manifold;

(b) determining the pressure present in the underpressure store;

(c) computing the additional air mass which flows from the pressure store into the intake manifold because of an actuation of the servo system; and, (d) correcting the air mass flow when an actuation of the servo system is detected, if required, by adding the additional air mass to the mass flow determined in the intake manifold.

For reasons of cost and for geometric reasons, it is advantageous when a pressure sensor in the intake manifold can be omitted. This is made possible in accordance with a further embodiment of the method of the invention whereby the pressure in the intake manifold is computed from the corrected mass flow based on an intake manifold model.

Costs can be further saved in that no pressure sensor is used in the underpressure store. Here, a method is appropriate with which the pressure, which is present in the underpressure store, is determined in that the mass flow supplied to the underpressure store and drawn out of the underpressure store is carried out.

In another embodiment of the method of the invention, the intensity of the actuation of the servo system is detected and the correction of the air mass flow is correspondingly adapted. This makes possible an especially exact correction of the air mass flow and a further reduction of the emissions.

Alternatively or in addition thereto, the correction can be so carried out in accordance with another embodiment of the invention that essentially no deviation of the air/fuel ratio (lambda value) from a desired value takes place when an actuation of the servo system is detected. The correction of the air mass flow here takes place therefore in dependence upon the lambda value, which is determined in the exhaust-gas pipe, and is therefore especially exact. This air mass flow forms the basis for the computation of the fuel quantity to be injected, the ignition time point, et cetera.

Another embodiment of the method of the invention is especially useful wherein the intensity of the correction of the air mass flow is used to monitor the operation of the underpressure store when an actuation of the servo system is determined. When the corrective term (required for the adjustment of the desired lambda value) for the air mass flow exceeds a pregiven limit value (that is, an air mass, which lies above a limit value, is evacuated from the underpressure store into the intake manifold), then this permits a conclusion to be drawn as to a leak in the underpressure store or in the brake booster. In such a case, a bit can be set, for example, in the electronic control unit, which permits a warning display to illuminate in the dashboard of a corresponding motor vehicle.

Another embodiment of the method of the invention goes in the same direction wherein the size of the deviation of the air/fuel ratio (lambda value) from a desired value is used for monitoring the operation of the underpressure store when an actuation of the servo system is determined.

The invention also relates to a computer program which is suitable for carrying out the above-described method when it is executed on a computer. It is especially advantageous when the computer program is stored on a memory, especially on a flash memory.

The invention relates finally also to a control system for an internal combustion engine, especially of a motor vehicle. An air mass is supplied to the engine via an intake manifold. An underpressure is applied via the intake manifold to an underpressure store of a servo system and the air mass flow in the inlet region of the intake manifold is determined.

According to the invention, it is provided that the control system detects the actuation of the servo system and corrects the determined air mass flow when an actuation of the servo system is detected.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
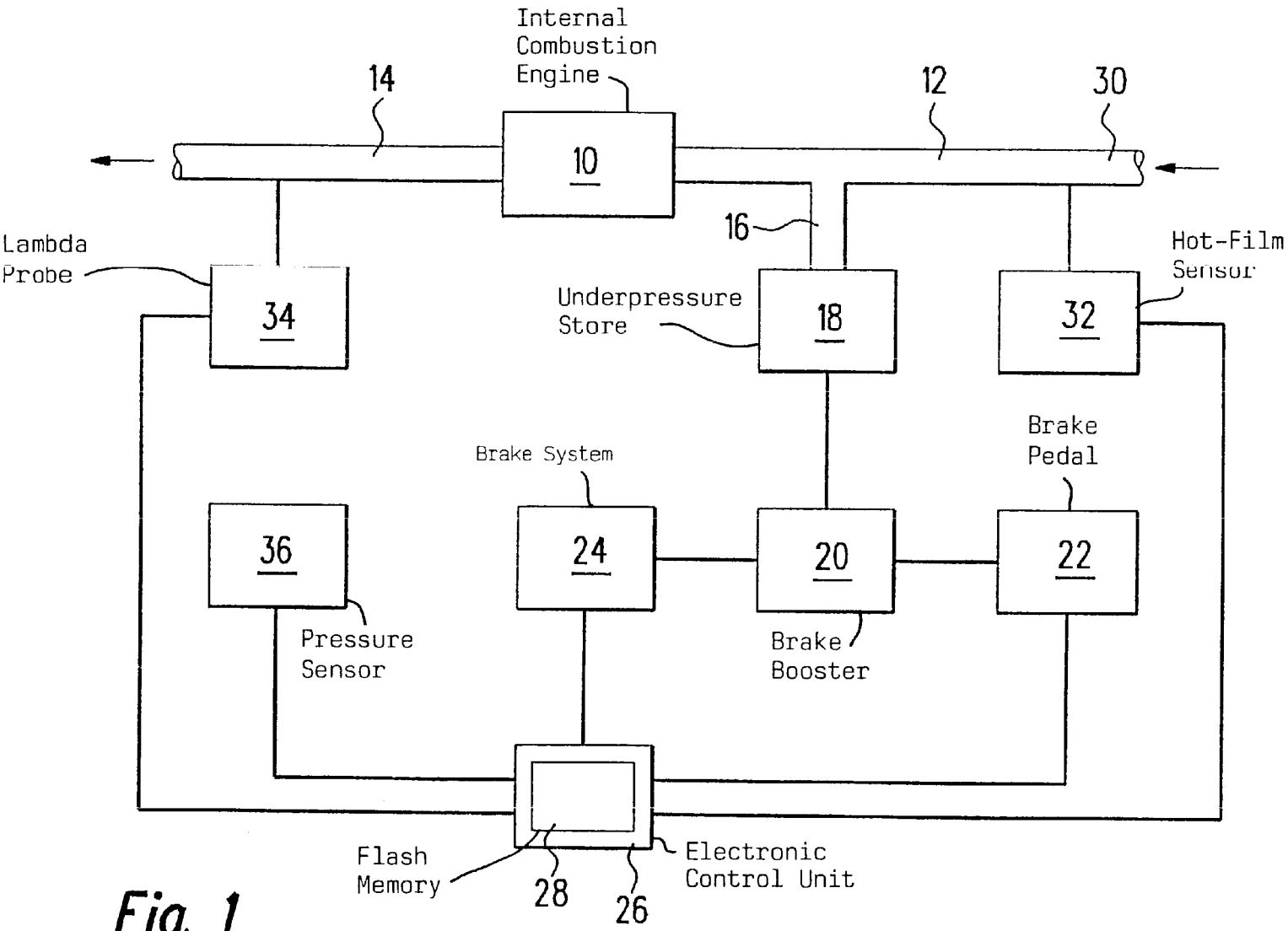
FIG. 1 is a block circuit diagram of an internal combustion engine of a motor vehicle in accordance with the invention and of several components which are needed for the control of the engine.

In FIG. 1, the internal combustion engine is identified by reference numeral 10 and has an inlet end connected to an intake manifold 12 and an outlet end connected to an exhaust-gas pipe 14. An underpressure store 18 is fluidly connected to the intake manifold 12 via a tap line 16. A check valve (not shown) can be mounted in the tap line 16 and prevents an air flow from the intake manifold 12 into the underpressure store 18.

The underpressure store 18 is connected to a brake booster 20 defining a servo system and this brake booster is, on the one hand, actuated by a brake pedal 22 and, on the other hand, operates on a brake device 24. The hydraulic pressure of the brake device 24, as the actuation of the brake pedal 22, is transmitted to an electronic control unit 26 which includes a flash memory 28 or a ROM (read-only-memory).

A hot-film sensor 32 is mounted in the inlet region 30 of the intake manifold 12. The hot-film sensor determines the air mass flow in the inlet region 30 of the intake manifold 12 in a manner known per se. The sensor 32 is also characterized as an HFM sensor. The signal of the HFM sensor 32 is likewise transmitted to the electronic control unit 26. In the same manner, a lambda probe 34 is provided in the exhaust-gas pipe 14 and the signal of the lambda probe is likewise transmitted to the electronic control unit 26. Finally, a pressure sensor 36 is provided which determines the ambient pressure and the corresponding signal is supplied to the electronic control unit 26.

Figure 2:
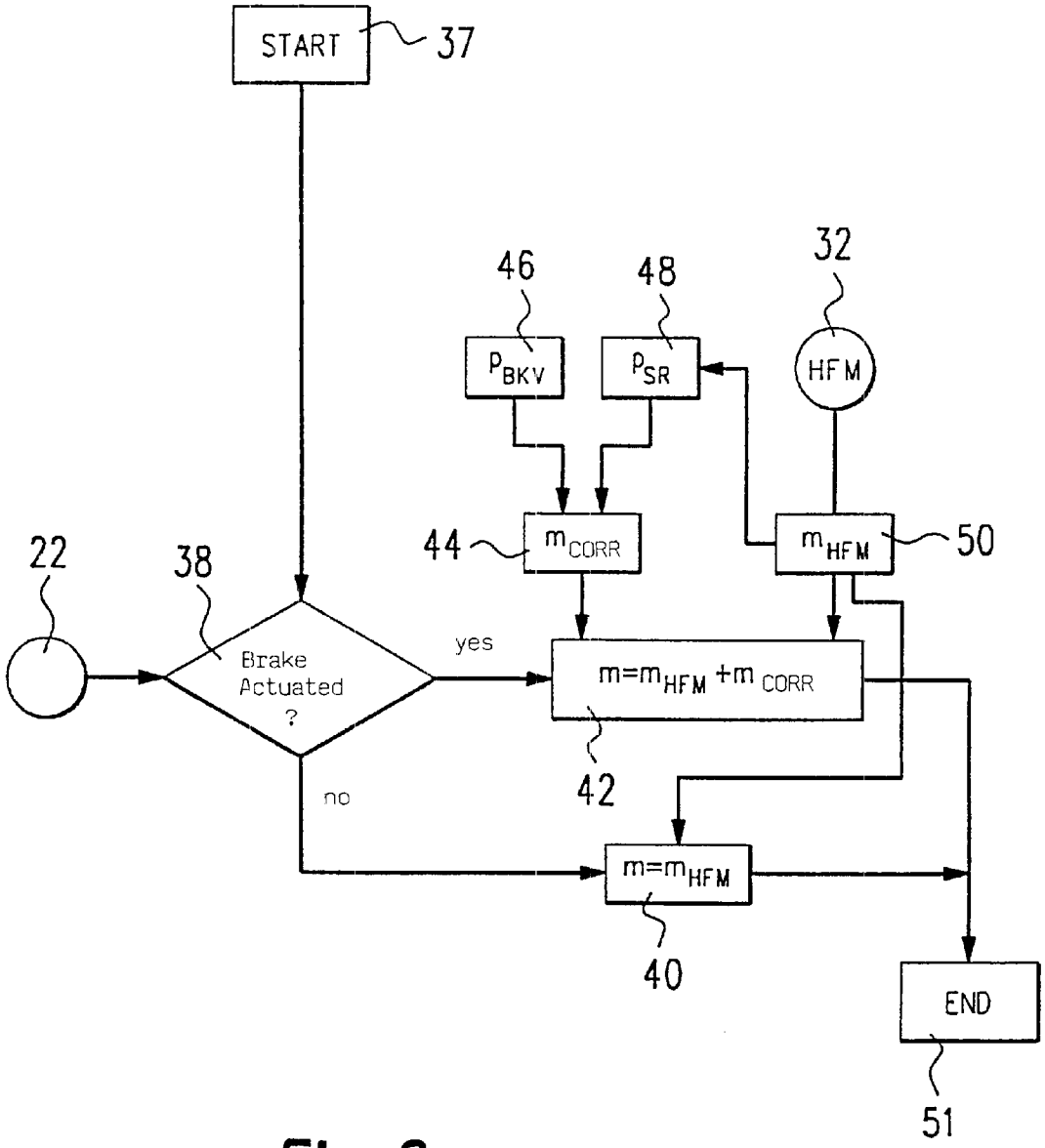
FIG. 2 shows a first embodiment of the method of the invention in the form of a sequence diagram.

A first embodiment of the method of the invention can operate in accordance with the system shown in FIG. 1 and is explained now with reference to the flowchart of FIG. 2.

After the start in block 37, a determination is first made in block 38 by the electronic control unit 26 as to whether a signal is present from the brake pedal 22 which indicates an actuation of the brake (it is understood that, with respect to an actuation of the brake, an increasing deceleration as well as a deceleration which becomes less, that is, a release of the brakes, is understood). Such a signal could, for example, be coupled to the illumination (or extinguishment) of the brake light. When the presence of such a signal is not determined, that is, the response to the question in block 38 is in the negative, then the air mass (m), which is actually supplied to the engine 10, in block 40 is set equal to the air mass $m_{HFM}$, which is measured by the HFM-sensor 32 (block 50), and this is used for the fill computation of the combustion chambers of the engine 10 (here, the correlating pressure in the intake manifold 12 is computed, inter alia, from the corresponding air mass based on an intake manifold model; this, however, is not shown in FIG. 2). The method ends in block 51.

If the brake is actuated or is alternatively released, that is, a corresponding signal is present from the brake pedal 22, the answer in block 38 is in the affirmative. In this case, a corrective term $m_{CORR}$ is added (block 42) to the value $m_{HFm}$ determined by the HFM-sensor 32. The corrective term $m_{CORR}$ is, in turn, computed in block 44 and is based on the underpressure $p_{BKV}$ (block 46) present in the underpressure store 18 and the pressure $p_{SR}$ (block 48) present in the intake manifold 12. The underpressure $p_{BKV}$ in the underpressure store 18 is computed via a mass balancing of the mass flows supplied to the underpressure store 18 and the mass flow drawn therefrom. The pressure $p_{SR}$, which is present in the intake manifold 12, is, as shown above, not measured but is computed based on an intake manifold model.

The value $m_{CORR}$ (block 44) is a value which corresponds to the theoretical air mass which flows from the underpressure store 18 into the intake manifold 12 when the brake booster 20 is actuated. This air mass is "theoretical" because it is dependent exclusively on the pressure difference between the pressure $p_{BKV}$, which is present in the underpressure store 18, and the pressure $p_{SR}$ which is present in the intake manifold 12. In reality, however, the corresponding air mass is also dependent upon the intensity with which the brake (that is, the brake pedal 22) is actuated. This is not considered in the method shown. Notwithstanding, good results are obtained already with the simplified method shown in FIG. 2, that is, the emission behavior of an engine 10, which is operated with this method, is considerably improved compared to a conventional internal combustion engine.

Figure 3:
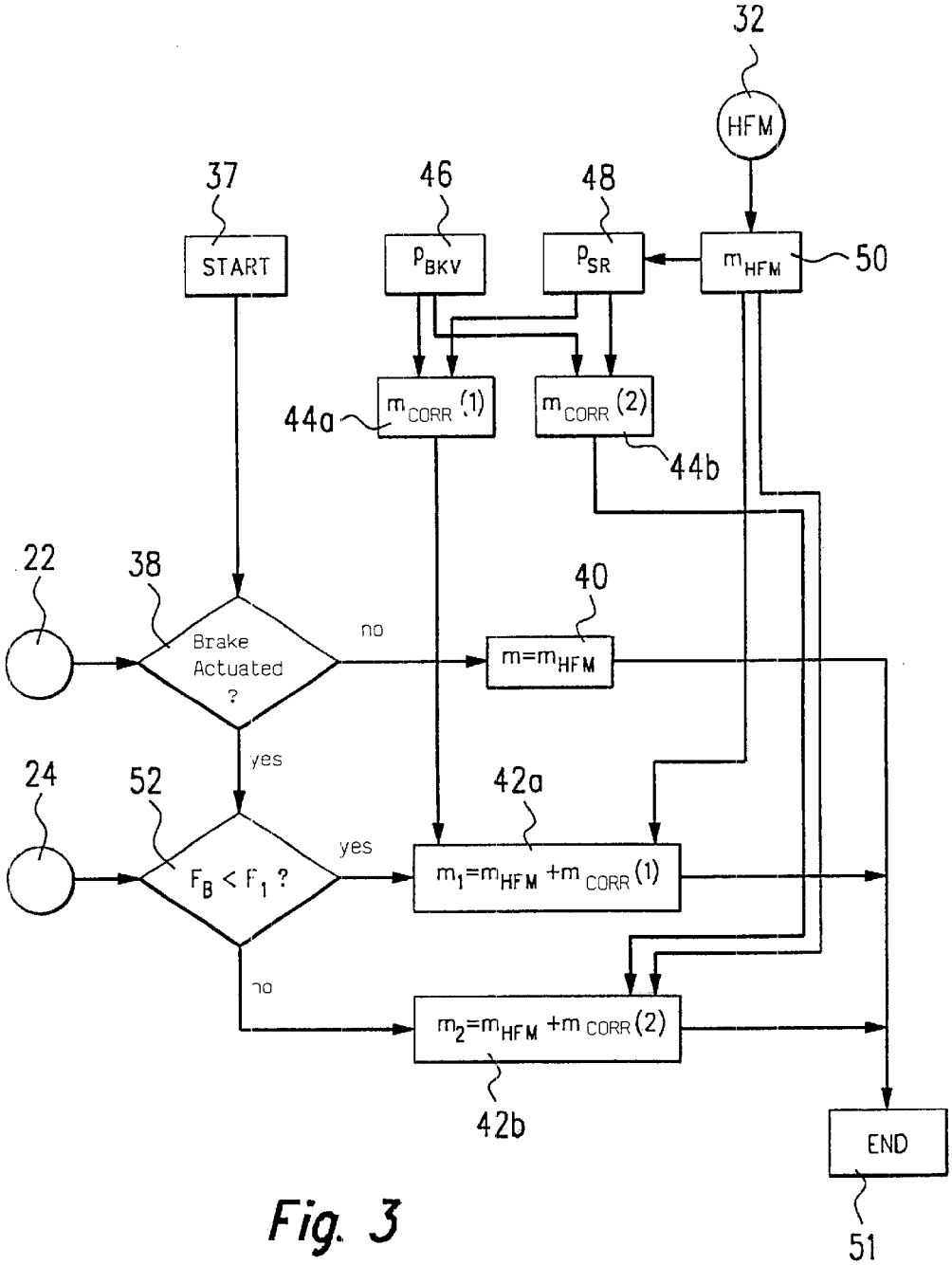
FIG. 3 shows a second embodiment of the method of the invention with respect to a flowchart.

A consideration of the intensity of braking or of the force applied by the user to the brake pedal 22 is possible for the embodiment of a method shown in FIG. 3. For this, blocks are provided which are functionally equivalent to such blocks of FIG. 2 and which have the same reference numerals.

First, it is noted that two corrective terms $m_{CORR1}$ (block 44*a*) and $m_{CORR2}$ (block 44*b*) are computed starting with the pressure $p_{BKV}$, which is prepared in block 46 and present in the underpressure store 18, and the pressure $p_{SR}$ which is present in the intake manifold 12 (block 48). The value $m_{CORR2}$, which is computed in block 44*b*, is greater than the value $m_{CORR1}$ computed in block 44*a*. If an actuation of the brake pedal 22 is determined in block 38, then a check takes place in block 52 as to whether the hydraulic brake pressure $F_B$ is less than a limit value $F_1$. The hydraulic brake pressure $F_B$ is transmitted from the brake system 24 to the control electronic unit 26. If the result of this check is positive (answer "yes"), this means that only a relatively low braking force is called up, that is, also only a relatively small air mass flows from the underpressure store 18 to the intake manifold 12. This air mass was initially determined in block 44*a* and is added in block 42*a* to the air mass $m_{HFM}$ (block 50) determined by the HFM-sensor 32.

If the result of the check in block 52 is negative, then it can be assumed that a braking with a relatively high braking force takes place and a relatively high ancillary force is called up from the brake booster 20. In this way, also the air quantity, which flows from the underpressure store to the intake manifold 12, is relatively large and corresponds to the value $m_{CORR2}$ computed in block 44*b*. This value is added in block 42*b* to the air mass $m_{HFM}$ (block 50) determined by the HFM-sensor 32.

The air quantity $m_1$ (relatively weak braking) or $m_2$ (relatively intense braking), which are computed in blocks 42*a* and 42*b*, form the basis of the fill computation of the combustion chambers in the engine 10 for a corresponding detected actuation of the brake pedal 22. The emission performance of the correspondingly driven engine 10 is further improved via the consideration provided in the method shown in FIG. 3.

Figure 4:
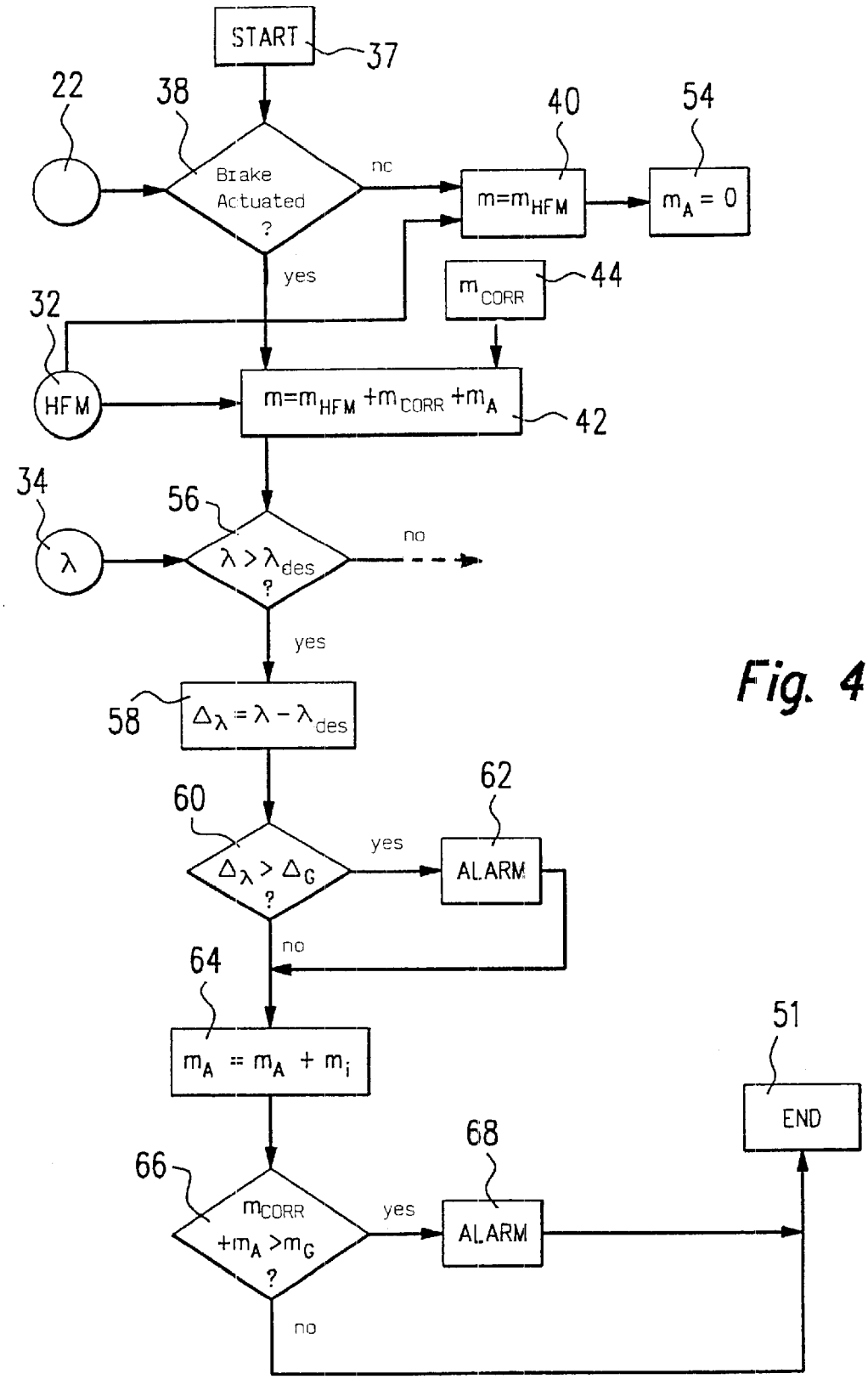
FIG. 4 shows a third embodiment of the method of the invention with respect to a flowchart; and, FIG. 5 shows a diagram wherein the course of the lambda value is plotted as a function of time with brake actuations.

A further improvement of the emission performance of the engine 10 and a function monitoring of the underpressure store 18 is possible in the embodiment shown in FIG. 4. Here too, blocks, which are the functional equivalents of those shown in FIGS. 2 or 3, have the same reference numerals.

If it is determined in block 38 that the brake pedal 22 has not been actuated, the air mass (m) is set equal in block 40 to the air mass $M_{HFM}$ determined by the HFM-sensor 32. The air mass (m) is the basis of the fill computation. Thereafter, an addition factor $m_A$ is set in block 54 to zero. The addition factor $m_A$ is explained in greater detail hereinafter.

If a brake actuation (or, alternatively, a release of the brake) is determined in block 38, then the corrective term $m_{CORR}$ is added in block 42 to the air mass $m_{HFM}$ determined by the HFM-sensor 32. In block 42, also the addition factor $m_A$ is added to this sum which is, however, equal to zero in the first passthrough of the loop. Thereafter, in block 56, a check is made as to whether the lambda value, which is measured by the lambda probe 34, is greater than a desired value $\lambda_{DES}$. The value $\lambda_{DES}$ is that lambda value at which the emission performance of the engine 10 is optimal. If the actual lambda value is less than the pregiven limit, this means that, in actuality, less air was supplied to the combustion chambers of the engine than was calculated. In this case, the computed air mass is corrected downwardly. If the actual lambda value $\lambda$ is greater than the optimal lambda value $\lambda_{DES}$, this means that more air is supplied in actuality to the combustion chambers of the engine 10 than was computed in block 42. This, in turn, means that the correction of the air flow, which is determined by HFM-sensor 32, is not sufficient yet in block 42.

In advance of an adaptation of the correction, it is first, however, checked as to whether the deviation of the actual lambda value $\lambda$ from the optimal value $\lambda_{DES}$ is greater than a pregiven limit value $\Delta_G$. This takes place in blocks 58 and 60.

First, the difference $\Delta_\lambda$ between the actual lambda value $\lambda$ and the optimal lambda value $\lambda_{DES}$ is determined in block 58. Then, in block 60, a check is made as to whether the difference $\Delta_\lambda$ is greater than the limit value $\Delta_G$. If this is the case, this means that the mixture is considerably too lean, that is, an excessive air quantity flows from the underpressure store 18 into the intake manifold 12. This, in turn, is an indication for a leak in the underpressure store 18. In this case, an alarm is triggered in block 62 which indicates to the user that an operational disturbance is present in the underpressure store 18.

After the check in block 60, an incrementation of the addition factor $m_A$ by a constant increment $m_i$ takes place in block 64. In block 66, one more operation check of the underpressure store 18 takes place in that the sum of the corrective term $m_{CORR}$ and the addition factor $m_A$ is compared to a limit value $m_G$. If the check in block 66 is positive, then an alarm in block 68 likewise takes place because a conclusion can be drawn as to a leak in the underpressure store 18 when the limit $m_G$ is exceeded. Thereafter, the program ends in block 51.

In the embodiments shown in FIGS. 2 to 4, a jump is made from end block 51 to the start block 37 as required. This back jump can be event controlled, for example, for a brake actuation or in a specific time-dependent clock pulse.

The method sequences shown in FIGS. 2 to 4 are especially suited for the execution as a computer program and for storage in the flash memory 26.

Figure 5:
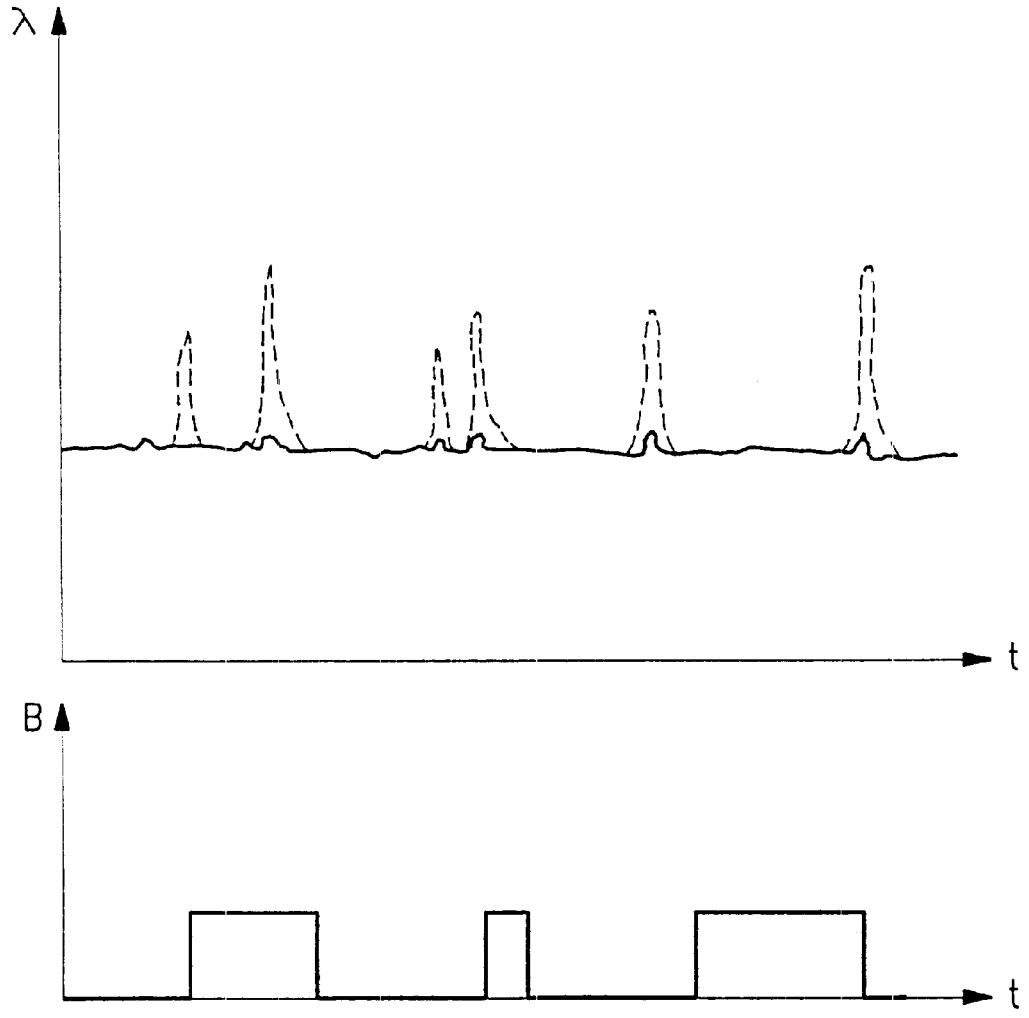

As shown in FIG. 5, considerable improvements are obtained with respect to the emission performance of the internal combustion engine 10 with a correction of the determined air mass flow $m_{HFM}$ in accordance with the method shown in FIG. 4. The diagram B/t shows brake actuations as a function in time; whereas, the diagram $\lambda$/t shows the corresponding value $\lambda$ as a function of time which is detected by the lambda probe 34 in the exhaust-gas pipe 14. In the $\lambda$/t diagram, the broken line curves show the corresponding values which are obtained without a correction of the air mass flow $m_{HFM}$.

It is understood that the foregoing description is that of the preferred embodiments of the invention and that various changes and modifications may be made thereto without departing from the spirit and scope of the invention as defined in the appended claims.

What is claimed is:

1. A control arrangement for a combination of an internal combustion engine and a servo system having an underpressure store, the control arrangement comprising:

an intake manifold for conducting an air mass to said engine;

means for applying an underpressure to said underpressure store via said intake manifold;

means for determining an air mass flow in said intake manifold;

means for detecting an actuation of said servo system; and, means for correcting the detected air mass flow when the actuation of said servo system is detected or directly thereafter.

2. The control arrangement of claim 1, comprising:

means for determining the pressure present in said intake manifold;

means for determining the pressure present in said underpressure store;

a computation loop for computing the additional air mass flowing from said underpressure store into said intake manifold because of the actuation of said servo system; and, an adding loop for adding the additional air mass to the air mass detected in the inlet region of said intake manifold.

3. The control arrangement of claim 2, further comprising a computation loop for determining the pressure in said intake manifold from the corrected mass flow utilizing a model of said intake manifold.

4. A computer program for carrying out a method in a combination of an internal combustion engine and a servo system having an underpressure store, the method being for determining the air mass supplied to the engine via an intake manifold thereof and the computer program comprising being suitable for carrying out the following method steps when executed on a computer:

applying an underpressure to said underpressure store via said intake manifold;

determining the air mass flow in the inlet region of said intake manifold;

detecting an actuation of said servo system; and, correcting the determined air mass flow at or directly after the detected actuation of said servo system.

5. The computer program of claim 4, wherein said program is stored on a memory.

6. The computer program of claim 5, wherein said memory is a flash memory.

7. In a combination of an internal combustion engine and a servo system having an underpressure store, a method for determining the air mass supplied to the engine via an intake manifold thereof, the method comprising the steps of:

applying an underpressure to said underpressure store via said intake manifold;

determining the air mass flow in the inlet region of said intake manifold;

detecting an actuation of said servo system; and, correcting the determined air mass flow at or directly after the detected actuation of said servo system.

8. The method of claim 7, comprising the further steps of:

determining the pressure present in said intake manifold;

determining the pressure present in said underpressure store;

computing the additional air mass flowing from said underpressure store into said intake manifold because of the actuation of said servo system; and, correcting the air mass flow when the actuation of said servo system is detected or directly thereafter.

9. The method of claim 8 comprising the further step of computing the pressure in said intake manifold from the corrected mass flow with a model of said intake manifold.

10. The method of claim 8, comprising the further step of determining said pressure present in said underpressure store by carrying out a mass balance of the mass flow supplied to said underpressure store and the mass flow conducted away from said underpressure store.

11. The method of claim 8, comprising the further step of detecting the intensity of the actuation of said servo system and adapting the correction of the air mass flow in correspondence thereto.

12. The method of claim 11, wherein the correction is carried out so that essentially no deviation of the air/fuel ratio (lambda value) from a desired value takes place when an actuation of said servo system is detected.

13. The method of claim 12, comprising the further step of applying the intensity of said correction of said air mass flow for monitoring the operation of said underpressure store when the actuation of said servo system is detected.

14. The method of claim 13, wherein the magnitude of said deviation of said air/fuel ratio (lambda value) from a desired value is used for monitoring the operation of said underpressure store when the actuation of said servo system is detected or directly thereafter.

15. The method of claim 7, wherein said air mass flow is corrected by adding said additional air mass flow to said air mass determined in said intake manifold.

* * * * *